US007490417B2

(12) United States Patent
Petrie

(10) Patent No.: US 7,490,417 B2
(45) Date of Patent: Feb. 17, 2009

(54) UNDERLAY STRAP SYSTEM

(75) Inventor: Jason G. Petrie, Portland, OR (US)

(73) Assignee: Nike, Inc., Beaverton, OR (US)

( * ) Notice: Subject to any disclaimer, the term of this patent is extended or adjusted under 35 U.S.C. 154(b) by 119 days.

(21) Appl. No.: 11/566,602

(22) Filed: Dec. 4, 2006

(65) Prior Publication Data

US 2007/0261269 A1 Nov. 15, 2007

(51) Int. Cl.
*A43C 11/00* (2006.01)

(52) U.S. Cl. ..... 36/50.1; 36/170

(58) Field of Classification Search ..... 36/50.1, 36/170, 58.6, 58.5
See application file for complete search history.

(56) References Cited

U.S. PATENT DOCUMENTS

| | | | | |
|---|---|---|---|---|
| 1,717,609 | A | | 6/1929 | Ludwig |
| 2,182,843 | A | * | 12/1939 | Flynn et al. ..... 36/170 |
| 3,327,410 | A | * | 6/1967 | Park, Sr. et al. ..... 36/89 |
| 3,837,098 | A | | 9/1974 | Rathmell |
| 4,476,639 | A | | 10/1984 | Zaccaria |
| 4,753,228 | A | | 6/1988 | Selner et al. |
| 4,845,864 | A | | 7/1989 | Corliss |
| 4,860,464 | A | | 8/1989 | Misevich et al. |
| 5,755,679 | A | | 5/1998 | Selner et al. |
| 5,840,053 | A | | 11/1998 | Roth |
| 5,897,518 | A | | 4/1999 | Shaw |
| 6,442,875 | B1 | | 9/2002 | Joubert et al. |
| 6,606,804 | B2 | | 8/2003 | Kaneko et al. |
| 6,775,929 | B2 | | 8/2004 | Katz et al. |
| 2001/0005948 | A1 | | 7/2001 | Pellegrini et al. |

FOREIGN PATENT DOCUMENTS

| | | | |
|---|---|---|---|
| GB | 2224426 A | * | 5/1990 |
| JP | 04367602 A | * | 12/1992 |

* cited by examiner

*Primary Examiner*—Ted Kavanaugh
(74) *Attorney, Agent, or Firm*—Plumsea Law Group, LLC

(57) ABSTRACT

An article of footwear including three independent fastening mechanisms is disclosed. The article of footwear includes a first strap, a second strap, and a lacing system. The first strap, the second strap, and the lacing system may all be configured to adjust or tighten the article of footwear to a wearer's foot along different regions. The first strap is tightened and fastened directly to the second strap. The second strap covers the first strap and a substantial majority of the lacing system.

27 Claims, 7 Drawing Sheets

UNDERLAY STRAP SYSTEM

BACKGROUND OF THE INVENTION

1. Field of the Invention

The present invention relates generally to footwear, and in particular the present invention relates to articles of footwear that include several straps for tightening the upper to a wearer's foot.

2. Description of Related Art

Systems for stabilizing a wearer's foot during motion have been proposed. Katz (U.S. Pat. No. 6,775,929) discloses a stabilization device for an athletic shoe or sneaker having two elongated straps for wrapping around a foot within a shoe. Selner (U.S. Pat. No. 4,753,228) discloses an apparatus that enhances retrograde stability to the major joints of the foot. A drawback to these stabilization systems is that the stabilization system is not integral to the footwear, and therefore must be applied independently, or instead of, a separate article of footwear.

Footwear including straps for tightening an upper to a wearer's foot have been disclosed. Zaccaria (U.S. Pat. No. 4,476,639) discloses a shoe with an adjustable strap fastening mechanism having a pull strap that is secured at one end of the insole of the shoe and disposed in wrap-around fashion about a wearer's foot in the region of the instep. However, this single strap design allows for the shoe to be tightened to the foot only along the instep region of the foot. Often, it may be desirable to provide a means of fastening a shoe at multiple locations, including the forefoot region.

Corliss (U.S. Pat. No. 4,845,864) discloses a cyclist's shoe, including separately adjustable inner and outer straps. The inner strap extends across the throat and along one side panel in a diagonal direction for primarily fitting the shoe to a cyclist's instep. The outer strap comprises a relatively large, flexible panel covering a substantial portion of the vamp around the throat. The outer strap extends across the vamp and the side panels in a transverse direction for primarily fitting the shoe to the cyclist's forefoot. While this design accommodates the need to fit a shoe at the instep and forefoot regions, both straps rest outside the upper. Since the upper itself often includes some amount of stiffness, these straps may not tighten as efficiently as straps that are disposed along the inside of the upper.

Misevich (U.S. Pat. No. 4,860,464) discloses a foot support structure attached to the outsole of a shoe to provide support to the medial arch and to girth the midfoot in a sling configuration. This multi-strap system provides a support sling construction with attachment to the shoe outsole such that adjustment is completely independent of rear-foot and forefoot fit. This design has the disadvantage of incorporating a large number of straps that prevents ease of use.

There is a need in the art for an article of footwear that makes use of several independent mechanisms of tightening the footwear upper to a wearer's foot at multiple regions, and which effectively combines ease of use, comfort, and aesthetics.

SUMMARY OF THE INVENTION

The invention discloses an article of footwear with independent fastening mechanisms. In one aspect, the invention provides an article of footwear, comprising: an upper which can be adjustably tightened around a wearer's foot; an outsole attached to the upper; a first strap, including a first portion; the first portion of the first strap being fixed to a first side of the upper and extendable across the article of footwear to a second side of the upper; a lacing system; a second strap, including a first end and a second end; and where the first end of the second strap being fixed to the second side of the upper and the second end of the second strap being adjustably fastened to the first side of the upper.

In another aspect, the first strap is disposed inside the upper along the first side of the upper and extending circumferentially towards the outsole.

In another aspect, the first end of the first strap is attached to the upper in a region of strobel stitching.

In another aspect, the lacing system is disposed proximate to a throat of the upper.

In another aspect, the first end of the first strap is fixed to the second side of the upper.

In another aspect, the first strap applies tension in a first region of the upper when the first strap is extended to the second side of the upper.

In another aspect, the lacing system applies tension to the upper by reducing the size of the throat.

In another aspect, the second strap applies tension to a second region of the upper.

In another aspect, the first region of the upper is a forefoot region.

In another aspect, the second region of the upper is an instep region.

In another aspect, the invention provides an article of footwear, comprising: an upper which can be adjustably tightened around a wearer's foot; an outsole attached to the upper; a first strap, including a first portion and a second portion; the first portion of the first strap being fixed to a first side of the upper and the second portion of the first strap being disposed through a slot on a second side of the upper; a lacing system; and a second strap, where the second portion of the first strap is releasably fastened to the second strap.

In another aspect, the laces are disposed proximate to a throat of the upper.

In another aspect, the first strap is associated with a forefoot region of a wearer's foot.

In another aspect, the second strap is associated with an instep of a wearer's foot.

In another aspect, the second portion is folded back on the first portion and the second portion is releasably fastened to the lower surface of the second strap.

In another aspect, the first portion of the first strap is adjacent to a tongue of the upper.

In another aspect, the invention provides an article of footwear, comprising: an upper which can be adjustably tightened around a wearer's foot; an outsole attached to the upper; a lacing system; a first strap including a first portion disposed below the lacing system; and a second strap disposed over the lacing system, where the second strap covers the first strap and a substantial majority of the lacing system.

In another aspect, the upper includes a tongue, and where the first portion of the first strap contacts the tongue.

In another aspect, the lace region corresponds to a throat of the upper.

In another aspect, the second strap is fixed to a first side of the upper.

In another aspect, the second strap adjustably fastens to a second side of the upper.

In another aspect, the lacing system contacts a tongue attached to the upper.

In another aspect, the invention provides an article of footwear comprising: an upper which can be adjustably tightened around a wearer's foot; an outsole attached to the upper; a lacing system; and a first strap including a first portion, a second portion, and an intermediate portion disposed between the first portion and the second portion, where the first portion of the first strap is disposed beneath the lacing system and the second portion of the first strap is disposed on top of the lacing system.

In another aspect, the first portion of the first strap is attached to a strobel stitching in the article of footwear.

In another aspect, the intermediate portion of the first strap is disposed through a slot in the upper.

In another aspect, the second portion of the first strap is disposed adjacent to the first portion of the first strap.

In another aspect, the first portion of the first strap contacts a tongue of the upper.

Other systems, methods, features and advantages of the invention will be, or will become apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

Figure 1:
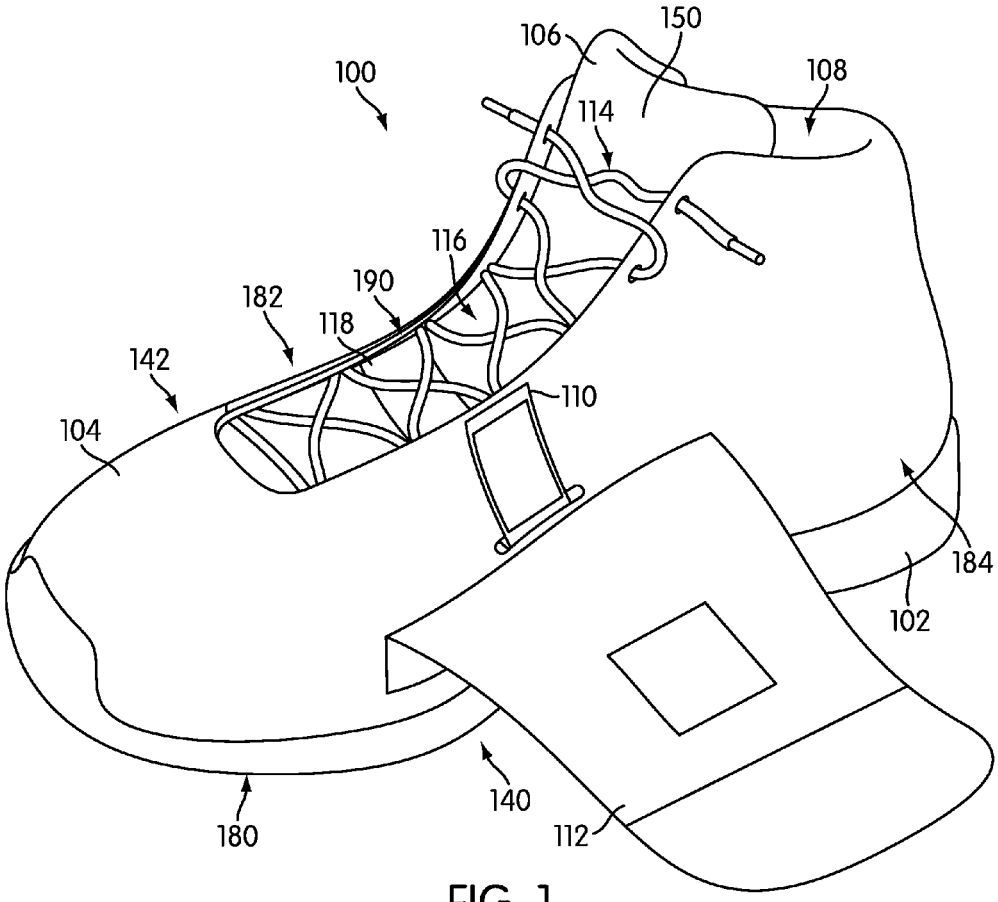
FIG. 1 is an isometric view of a preferred embodiment of an article of footwear.

FIG. 1 is an isometric view of a preferred embodiment of article of footwear 100. Article of footwear 100 may be any type of footwear. In some embodiments, article of footwear 100 may be a type of athletic footwear. Article of footwear 100 preferably includes outsole 102 and upper 104. Outsole 102 and upper 104 may be composed of any material. In particular, upper 104 may be composed of a synthetic material or a natural material such as leather. In some embodiments, upper 104 will be composed of multiple materials. Furthermore, upper 104 preferably includes forefoot region 180, throat region 182, and heel region 184.

In a preferred embodiment, upper 104 includes wide opening 108 and narrow opening 116. Wide opening 108 is preferably configured to receive a wearer's foot. In a preferred embodiment, narrow opening 116 coincides with throat region 182 of upper 104, and may allow additional space into which a wearer's foot may be placed in order to fully insert the foot into article of footwear 100. In preferred embodiment, upper 104 may also include tongue 106. Tongue 106 is a portion of upper 104 that may move independently from the remaining portions of upper 104. Tongue 106 generally corresponds with narrow opening 116. Tongue 106 is preferably disposed between narrow opening 116 and a wearer's foot, following the insertion of the wearer's foot.

Typically, an article of footwear includes some mechanism for tightening the upper around a wearer's foot. Often, a lacing system is provided to constrict the throat of the upper. As the throat of the upper constricts, the upper is tightened around the wearer's foot, especially in the instep region. Article of footwear 100 preferably includes lacing system 114. Lacing system 114 preferably allows a wearer to tighten upper 104 to the wearer's foot. In a preferred embodiment, lacing system 114 is disposed adjacent to tongue 106 and proximate to throat region 182. As lacing system 114 is tightened, upper 104 is constricted along throat region 182. This constriction of throat region 182 occurs because a second side 140 and a first side 142 of upper 104 are pulled closer together, along outer periphery 190 of narrow opening 116, as lacing system 114 is tightened. This constriction of throat region 182 tightens the upper to the wearer's foot along the instep of the wearer's foot. Furthermore, narrow opening 116 and wide opening 108 are constricted, preventing the wearer's foot from slipping out of either narrow opening 116 or wide opening 108.

Lacing system 114 may include any system intended to constrict the throat region of an article of footwear via tension applied along a narrow opening that separates a first side of an upper from a second side of an upper. Some examples of such lacing systems include zippers and shoe laces. These examples are not intended to be an exhaustive list of possible lacing systems. In the preferred embodiment, lacing system 114 is a set of shoe laces.

In addition to lacing system 114, article of footwear 100 preferably includes two additional mechanisms for adjustably tightening upper 104 to a wearer's foot. The first mechanism is first strap 110 and the second mechanism is second strap 112. First strap 110 is preferably disposed near forefoot region 180 of upper 104. Generally, first strap 110 may be used to tighten upper 104 to the lower instep of a wearer's foot, or even the knuckles of the toes. Usually, though a lacing system helps to constrict the upper around a wearer's foot, tightening the lacing system does not secure the forefoot region of a wearer's foot in place. Using first strap 110 allows a wearer to secure their forefoot in place while simultaneously tightening the upper around a wearer's foot along the instep region through the use of lacing system 114. First portion 118 of first strap 110 is preferably disposed between tongue 106 and lacing system 114. As first strap 110 is tightened, it applies a downward pressure to tongue 106, which further applies pressure to the forefoot region of a wearer's foot, securing this portion of the foot in place.

Figure 2:
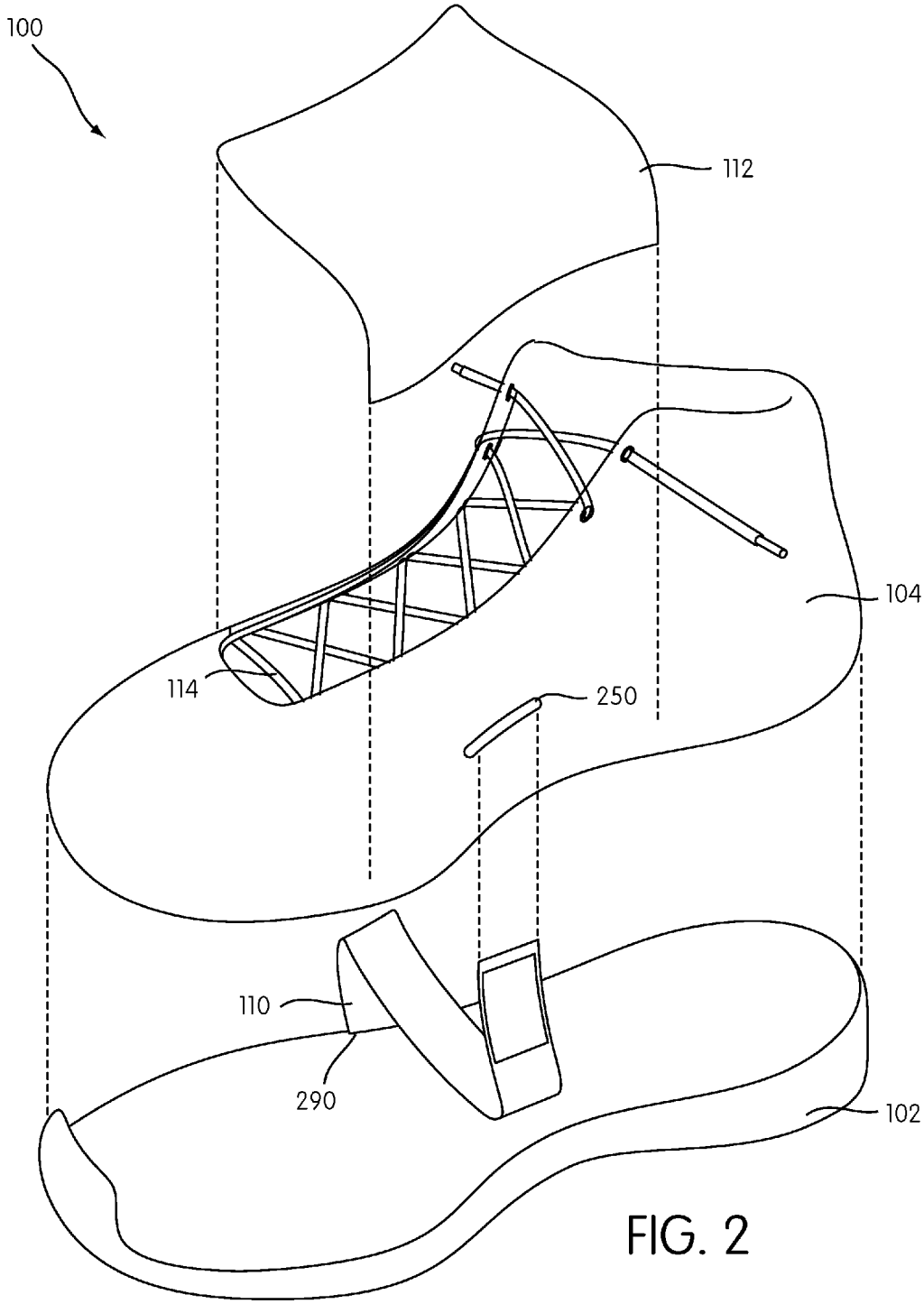
FIG. 2 is an exploded isometric view of a preferred embodiment of an article of footwear.

The preferred positioning of first strap 110 throughout the upper may be most clearly seen in FIG. 2, an exploded isometric view of a preferred embodiment of article of footwear 100. In a preferred embodiment, first strap 110 is attached to outsole 102 at strobel stitching 290. First strap 110 is also configured to enter slot 250, disposed along upper 104. Lacing system 114, integrated into upper 104, is preferably disposed just above first strap 110. Finally, second strap 112 is located above lacing system 114. In order to emphasize the positioning of first strap 110 within upper 104, tongue 116 of upper 104 is not shown in FIG. 2.

Figure 3:
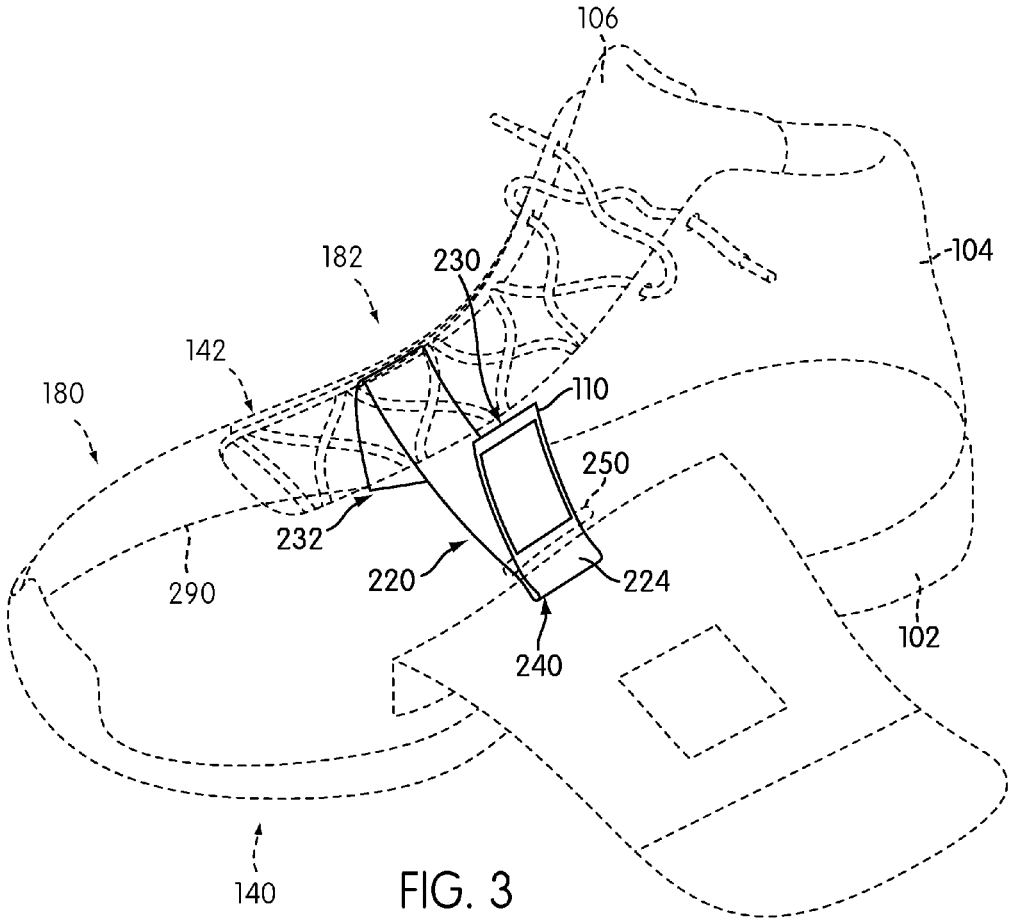
FIG. 3 is an isometric view of a preferred embodiment of an article of footwear with a first strap extending to the strobel stitching.

FIG. 3 is a partial isometric view of a preferred embodiment of article of footwear 100. Here, upper 104 and outsole 102 are shown in phantom. First strap 110 preferably includes a first portion 220 and second portion 224. First portion 220 of first strap 110 is defined to be any portion of first strap 110 disposed between slot 250 and first end 232 of first strap 110. Second portion 224 of first strap 110 is defined to be any portion of first strap 110 disposed between slot 250 and second end 230 of first strap 110. That is, first portion 220 of first strap 110 is generally enclosed within upper 104, while second portion 224 of first strap 110 is generally located outside of upper 104. In a preferred embodiment, first strap 110 also includes intermediate portion 240 that is disposed between first portion 220 and second portion 224 of first strap 110. Intermediate portion 240 is preferably disposed proximate to slot 250. As first strap 110 is pulled, the sizes of first portion 220 and second portion 224 will vary, as more or less of first strap 110 is disposed outside of upper 104.

In some embodiments, first portion 220 of first strap 110 is disposed, extending circumferentially towards outsole 102 along first side 142 of upper 104. First portion 220 of first strap 110 may extend all the way to strobel stitching 290 where upper 104 is fastened to outsole 102. That is, first end 232 of first strap 110 may be attached to upper 104 at strobel stitching 290. However, first portion 220 of first strap 110 need not extend all the way to strobel stitching 290.

In general, first portion 220 of first strap 110 will be fixed to first side 142 of upper 104, and extend across article of footwear 100 to second side 140 of upper 104. In this embodiment, first strap 110 is disposed near forefoot region 180. In some embodiments, first strap 110 may be disposed at different positions along throat region 182 as well. Also, first strap 110 may have any size and thickness. In some embodiments, the orientation of first strap 110 may be reversed, where first strap 110 may be fixed to second side 140 and extendable across to first side 142. First end 232 of first strap 110 may be attached to second side 140 of upper 104, extending across the article of footwear to first side 142 of upper 104.

Figure 4:
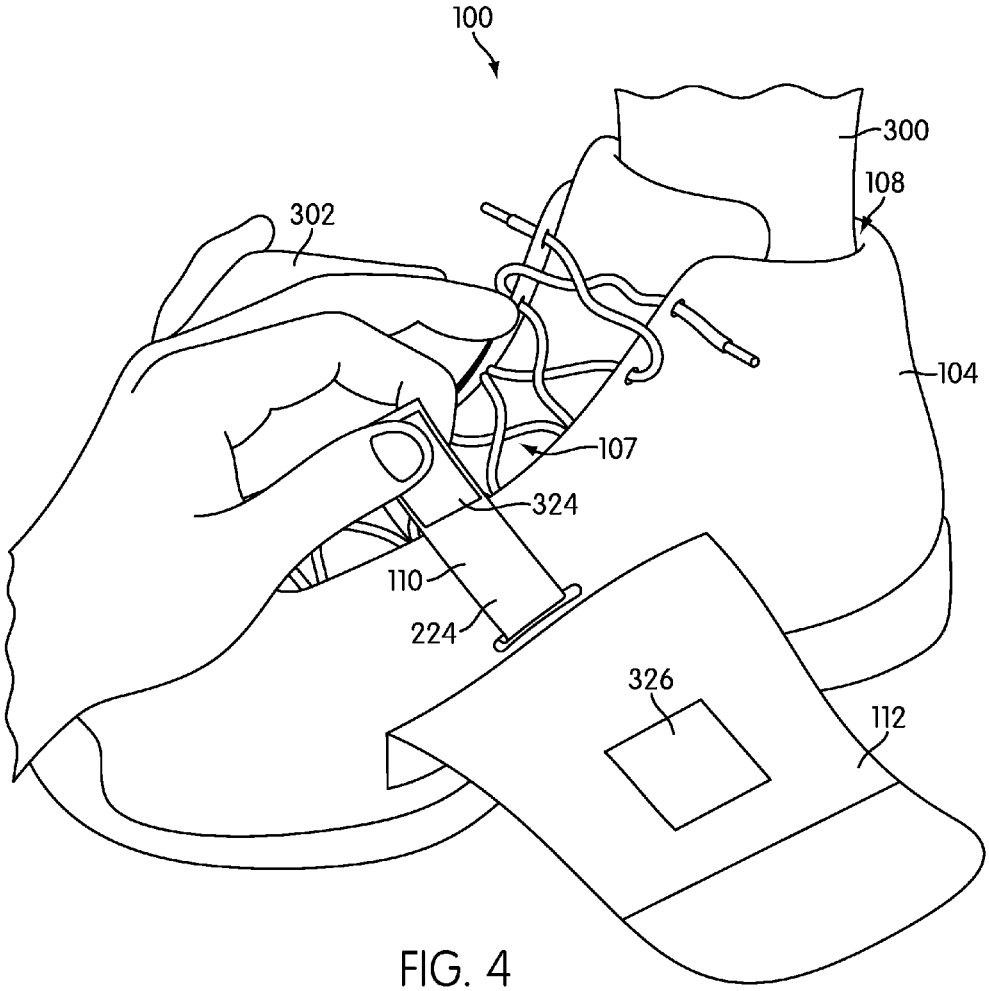
FIG. 4 is an isometric view of a preferred embodiment of an article of footwear with an extended first strap.

Tightening first strap 110 can be the first step in adjusting the upper to properly fit a wearer's foot. FIG. 4 shows one way to tighten a preferred embodiment of article of footwear 100 after a wearer's foot 300 into article of footwear 100. A wearer's hand 302 is seen pulling on second portion 224 of first strap 110. As second portion 224 of first strap 110 is pulled, first portion 220 (not shown in FIG. 4) of first strap 110 tightens, constraining the movement of the forefoot of the wearer's foot 300 within upper 104. The wearer may adjust first strap 110 to suit any particular need. In some situations, a wearer may have large toe knuckles, and first strap 110 may be only slightly tightened to allow for a comfortable fit. In other situations, the wearer may have a small forefoot region and may significantly tighten first strap 110 in order to reduce the possibility of in-shoe motion of the forefoot.

A provision for securing first strap 110 in place once the wearer has tightened it is preferably included in article of footwear 100. Typically, a strap would be secured by fixing it at opposing ends of an upper. However, in a preferred embodiment of article of footwear 100, first strap 110 is attached directly to second strap 112. This may reduce the tendency of first strap 110 to loosen, which may occur if first strap 110 were folded back over the top of the upper before being fastened in place. In a preferred embodiment, first strap 110 includes first attachment region 324. Likewise, second strap 112 preferably includes second attachment region 326. In particular, second attachment region 326 is configured to receive first attachment region 324 of first strap 110.

In some embodiments, first attachment region 324 and second attachment region 326 are two sides of a hook and loop fastening system. In a preferred embodiment, each attachment region 324, 326 is a cooperating region of Velcro®. Other examples of attachment systems include any other type of hook or loop fastening system, magnets, snaps, as well as other attachment systems.

Figure 5:
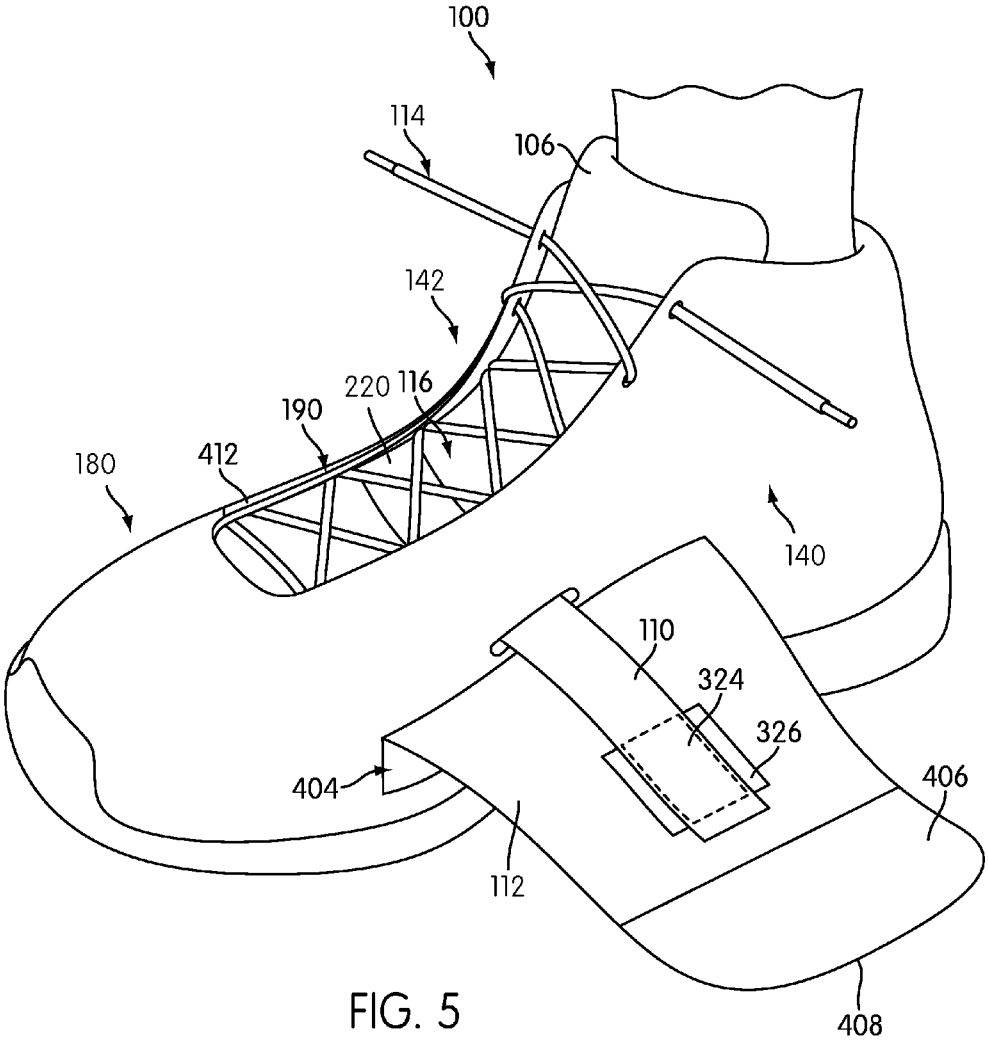
FIG. 5 is an isometric view of a preferred embodiment of an article of footwear with the first strap attached to the second strap.

By joining first attachment region 324 and second attachment region 326, first strap 110 is releasably fastened to second strap 112. This fastening keeps first strap 110 taut. FIG. 5 is an isometric view of a preferred embodiment of article of footwear 100, once first strap 110 has been fastened to second strap 112. First attachment region 324, disposed above second attachment region 326, is shown here in phantom. In particular, first strap 110 may be adjusted and secured in place at any length that allows some overlap between first attachment region 324 and second attachment region 326. In general, longer attachment regions 324, 326 allow for a wider range of adjustments in the length of second portion 224 of first strap 110.

Once first strap 110 has been fastened in place, the wearer may adjust lacing system 114 in order to tighten the upper to the wearer's foot along the instep region of the foot. Referring to FIG. 5, lacing system 114 may be tightened. In a preferred embodiment, first portion 220 of first strap 110 is disposed beneath lacing system 114. This allows first strap 110 to tighten forefoot portion 180 of upper 104 independently of lacing system 114.

Second strap 112 is an additional mechanism for securing article of footwear 100 to a wearer's foot. In a preferred embodiment, first end 404 of second strap 112 is fixed to second side 140 of upper 104. Second strap 112 also preferably includes a third attachment region 406 at second end 408 of second strap 112. In addition, upper 104 preferably includes a fourth attachment region 412 along first side 142 and adjacent to outer periphery 190. Third attachment region 406 and fourth attachment region 412 may include any of the fastening systems previously discussed for the first and second attachment regions, as well as any other type of fastening system.

Figure 6:
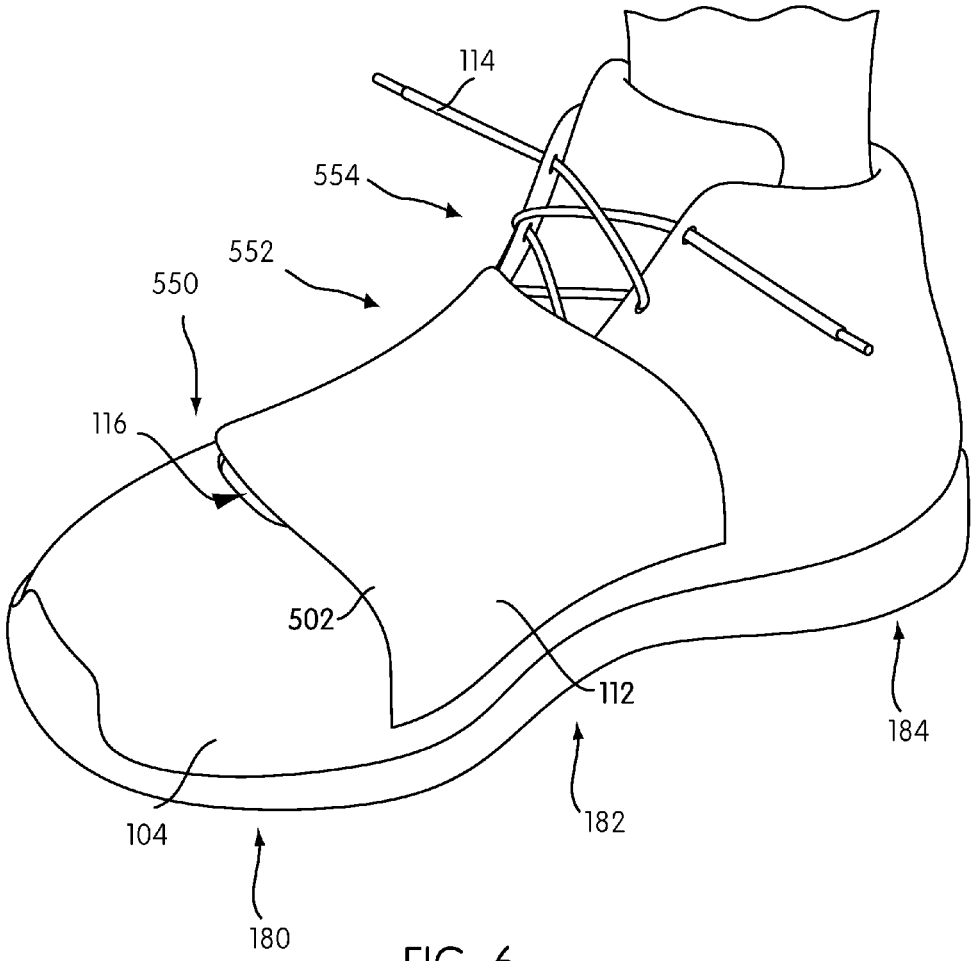
FIG. 6 is an isometric view of a preferred embodiment of an article of footwear with the second strap closed.

Once first strap 110 and lacing system 114 have been adjusted, second strap 112 may be pulled taut and folded over narrow opening 116. FIG. 6 is a preferred embodiment of article of footwear 100 with second strap 112 folded over narrow opening 116. Second strap 112 is fixed in place by joining the third attachment region and the fourth attachment region (not shown in FIG. 6). In this way, second strap 112 is adjustably fastened to first side 142 of upper 104. Second strap 112 is preferably wider than the first strap. In some embodiments, second strap 112 may cover the entirety of narrow opening 116, including any portion of lacing system 114. In a preferred embodiment, second strap 112 covers the entirety of the first strap. By covering the first strap and a portion of lacing system 114, second strap 112 serves to protect the first strap and lacing system 114 from loosening. That is, second strap 112 prevents other objects from contacting the first strap and lacing system 114, which might possibly lead to the first strap and/or lacing system 114 being loosened.

In some embodiments, second strap 112 may also provide an aesthetic element to article of footwear 100. Second side 502 of second strap 112 may include any shapes, patterns, or designs. Additionally, second side 502 of second strap 112 provides a single coherent surface for the top of article of footwear 104, since in some embodiments second strap 112 may hide first strap 110 and lacing system 114. In some embodiments, second strap 112 may be composed of a similar material to upper 104. In other embodiments, second strap 112 may be composed of a different material than upper 104.

In some embodiments, first strap 110, second strap 112, and lacing system 114 apply tension in different regions of upper 104. First strap 110 preferably applies tension to a first region 550 of upper 104. In a preferred embodiment, first region 550 corresponds to forefoot region 180. However, in some embodiments, first strap 110 may be modified to apply tension to another region of upper 104. Second strap 112 preferably applies tension to a second region 552 of upper 104. In a preferred embodiment, second region 552 of upper 104 corresponds to throat region 182. However, as with first strap 110, in some embodiments, second strap 112 may be modified to apply tension to upper 104 in another region.

Finally, lacing system 114 preferably applies tension to a third region 554 of upper 104. In some embodiments, third region 554 of upper 104 corresponds to throat region 182. That is, both second strap 112 and lacing system 114 may apply tension to the same region of upper 104. This should not be seen as a redundant design, since each type of fastening system applies a different amount and type of tension. Furthermore, often lacing system 114 will apply tension in a third region that is slightly different from throat region 182. Lacing system 114 may apply tension in a region that overlaps with forefoot region 108, throat region 182, and even heel region 184.

Figure 7:
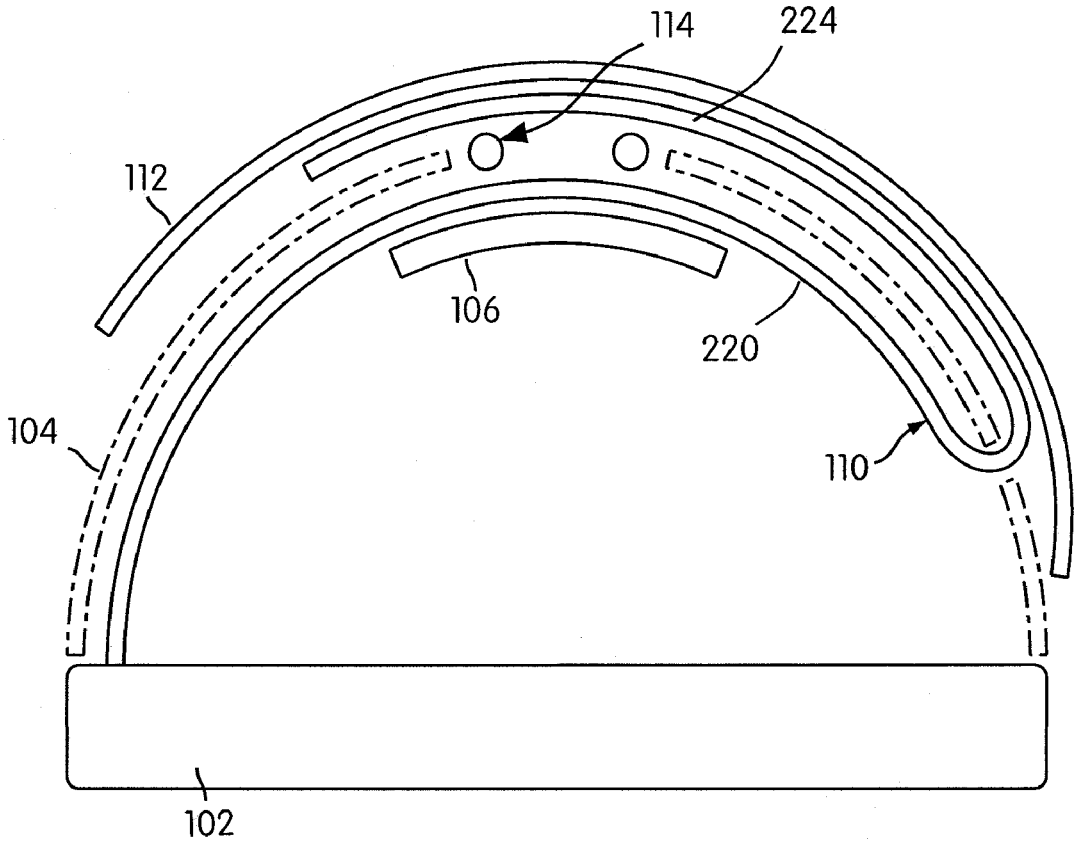
FIG. 7 is a cross-sectional view of a preferred embodiment of an article of footwear.

As shown in FIG. 7, upon tightening the three fastening mechanisms, first strap 110, lacing system 114 and second strap 112 essentially form layers with upper 104 (shown in phantom). Tongue 106 is preferably disposed above outsole 102. First portion 220 of first strap 110 is preferably disposed above tongue 106. First portion 220 of first strap 110 is also preferably disposed below lacing system 114. Preferably, lacing system 114 is disposed between first portion 220 of first strap 110 and second portion 224 of first strap 110. Second portion 224 of first strap 110 is preferably disposed between lacing system 114 and second strap 112.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. An article of footwear, comprising:

an upper which can be adjustably tightened around a wearer's foot;

an outsole attached to the upper;

a first strap, including a first portion and a second portion;

the first portion of the first strap being fixed to a first side of the upper and extendable across the article of footwear to a second side of the upper;

a lacing system;

a second strap, including a first end and a second end;

the first end of the second strap being fixed to the second side of the upper and the second end of the second strap being adjustably fastened to the first side of the upper; and the second portion of the first strap being adjustably fastened to an underside of the second strap, thereby allowing independent adjustability of each of the first and second straps to apply tension in different regions of the upper.

2. The article of footwear according to claim 1, wherein the first strap is disposed inside the upper along the first side of the upper and extending circumferentially towards the outsole.

3. The article of footwear according to claim 2, wherein the first end of the first strap is attached to the upper in a region of strobel stitching.

4. The article of footwear according to claim 1, wherein the lacing system is disposed proximate to a throat of the upper.

5. The article of footwear according to claim 1, wherein the first end of the second strap is fixed to the second side of the upper.

6. The article of footwear according to claim 1, wherein the first strap applies tension in a first region of the upper when the first strap is extended to the second side of the upper.

7. The article of footwear according to claim 6, wherein the first region of the upper is a forefoot region.

8. The article of footwear according to claim 1, wherein the lacing system applies tension to the upper by reducing the size of the throat.

9. The article of footwear according to claim 1, wherein the second strap applies tension to a second region of the upper.

10. The article of footwear according to claim 9, wherein the second region of the upper is an instep region.

11. An article of footwear, comprising:

an upper which can be adjustably tightened around a wearer's foot;

an outsole attached to the upper;

a first strap, including a first portion and a second portion;

the first portion of the first strap being fixed to a first side of the upper and the second portion of the first strap being disposed through a slot on a second side of the upper;

a lacing system; and a second strap, wherein the second portion of the first strap is releasably fastened to a lower surface of the second strap.

12. The article of footwear according to claim 11, wherein the laces are disposed proximate to a throat of the upper.

13. The article of footwear according to claim 11, wherein the first strap is associated with a forefoot region of a wearer's foot.

14. The article of footwear according to claim 11, wherein the second strap is associated with an instep of a wearer's foot.

15. The article of footwear according to claim 11, wherein the second portion is folded back on the first portion.

16. The article of footwear according to claim 11, wherein the first portion of the first strap is adjacent to a tongue of the upper.

17. An article of footwear, comprising:

an upper which can be adjustably tightened around a wearer's foot;

an outsole attached to the upper;

a lacing system;

a first strap including a first portion disposed below the lacing system;

a second strap disposed over the lacing system, wherein the second strap covers the first strap and at least a portion of the lacing system; and wherein a second portion of the first strap is removably fastened to a lower surface of the second strap.

18. The article of footwear according to claim 17, wherein the upper includes a tongue, and wherein the first portion of the first strap contacts the tongue.

19. The article of footwear according to claim 17, wherein the lace region corresponds to a throat of the upper.

20. The article of footwear according to claim 17, wherein the second strap is fixed to a first side of the upper.

21. The article of footwear according to claim 20, wherein the second strap adjustably fastens to a second side of the upper.

22. The article of footwear according to claim 17, wherein the lacing system contacts a tongue attached to the upper.

23. An article of footwear comprising:

an upper which can be adjustably tightened around a wearer's foot;

an outsole attached to the upper;

a lacing system;

a first strap including a first portion, a second portion, and an intermediate portion disposed between the first portion and the second portion, wherein the first portion of the first strap is disposed beneath the lacing system and the second portion of the first strap disposed on top of the lacing system; and a second strap including a lower surface, wherein the second portion of the first strap is removably secured to the lower surface of the second strap and a portion of the second strap is disposed on top of the second portion of the first strap in operative position.

24. The article of footwear according to claim 23, wherein the first portion of the first strap is attached to a strobel stitching in the article of footwear.

25. The article of footwear according to claim 23, wherein the intermediate portion of the first strap is disposed through a slot in the upper.

26. The article of footwear according to claim 23, wherein the second portion of the first strap is disposed adjacent to the first portion of the first strap.

27. The article of footwear according to claim 23, wherein the first portion of the first strap contacts a tongue of the upper.

* * * * *